US007036821B2

(12) United States Patent
Hall

(10) Patent No.: US 7,036,821 B2
(45) Date of Patent: May 2, 2006

(54) CARD GAME

(76) Inventor: Geoffrey William Hall, 323 Haslucks Green Road, Shirley, Solihull, West Midlands (GB), B90 2NF ( * ) Notice: Subject to any disclaimer, the term of this patent is extended or adjusted under 35 U.S.C. 154(b) by 39 days.

(21) Appl. No.: 10/399,138

(22) PCT Filed: Oct. 8, 2001

(86) PCT No.: PCT/GB01/04478

§ 371 (c)(1),
(2), (4) Date: Apr. 10, 2003

(87) PCT Pub. No.: WO02/30528

PCT Pub. Date: Apr. 18, 2002

(65) Prior Publication Data

US 2003/0178776 A1 Sep. 25, 2003

(30) Foreign Application Priority Data

Oct. 11, 2000 (GB) ..... 00248617

(51) Int. Cl.
*A63F 1/00* (2006.01)

(52) U.S. Cl. ..... 273/292; 273/274; 273/309

(58) Field of Classification Search ..... 273/274, 273/292, 309
See application file for complete search history.

(56) References Cited

U.S. PATENT DOCUMENTS 5,280,915 A 1/1994 Groussman
5,322,295 A * 6/1994 Cabot et al. ..... 273/292
5,382,025 A * 1/1995 Sklansky et al. ..... 273/292
5,403,015 A * 4/1995 Forte et al. ..... 273/304
5,529,309 A * 6/1996 Bartlett ..... 273/292
5,636,842 A * 6/1997 Cabot et al. ..... 273/292
5,732,949 A 3/1998 Josephs
5,810,360 A * 9/1998 Srichayaporn ..... 273/292
5,829,750 A 11/1998 Booker
5,882,009 A * 3/1999 Schaefer ..... 273/292
6,000,699 A 12/1999 Long
D427,644 S * 7/2000 Stern ..... D21/397
6,098,984 A * 8/2000 Moore, Jr. ..... 273/392
6,196,548 B1 * 3/2001 Schaefer ..... 273/292
6,406,024 B1 * 6/2002 Perkins ..... 273/292
6,435,507 B1 * 8/2002 Trucksess ..... 273/292
6,471,210 B1 * 10/2002 Goldman et al. ..... 273/292
6,511,068 B1 * 1/2003 Sklansky et al. ..... 273/237
6,543,773 B1 * 4/2003 Mims ..... 273/292
6,575,464 B1 * 6/2003 Fertitta et al. ..... 273/274
6,688,599 B1 * 2/2004 Manalili ..... 273/303
6,703,329 B1 * 3/2004 Principe ..... 442/316
6,723,668 B1 * 4/2004 Principe ..... 442/316
2001/0040345 A1 * 11/2001 Au-Yeung ..... 273/303
2002/0008356 A1 * 1/2002 De Keller ..... 273/292
2002/0033577 A1 * 3/2002 Mims ..... 273/292
2002/0074724 A1 * 6/2002 Webb ..... 273/274
2002/0123279 A1 * 9/2002 Principe ..... 442/80

(Continued)

OTHER PUBLICATIONS

Derwent—2004—169249Gaming Cloth For Covering Playing surface Of Gaming table In casino– 1999 J.A. Brasier & S.J. Lobley.*

*Primary Examiner*—Stephen Blau
*Assistant Examiner*—Dolores R. Collins
(74) *Attorney, Agent, or Firm*—Davis & Bujold, P.L.L.C.

(57) ABSTRACT

A card game is played with a set of playing cards and a gaming cloth (10), the gaming cloth (10) defining an area (12) in which a dealer may deal two or more cards constituting a house hand, and a plurality of player areas; each player area defining an area (14,16) in which two or more hands comprised of two or more cards may be dealt to a player; areas (18,20) corresponding to each hand for placing a bet on the hands beating the house hand; and an area (22) in which optional bets may be placed on the matching of the cards dealt to each player to specified hands.

11 Claims, 1 Drawing Sheet

U.S. PATENT DOCUMENTS

Figure 1:
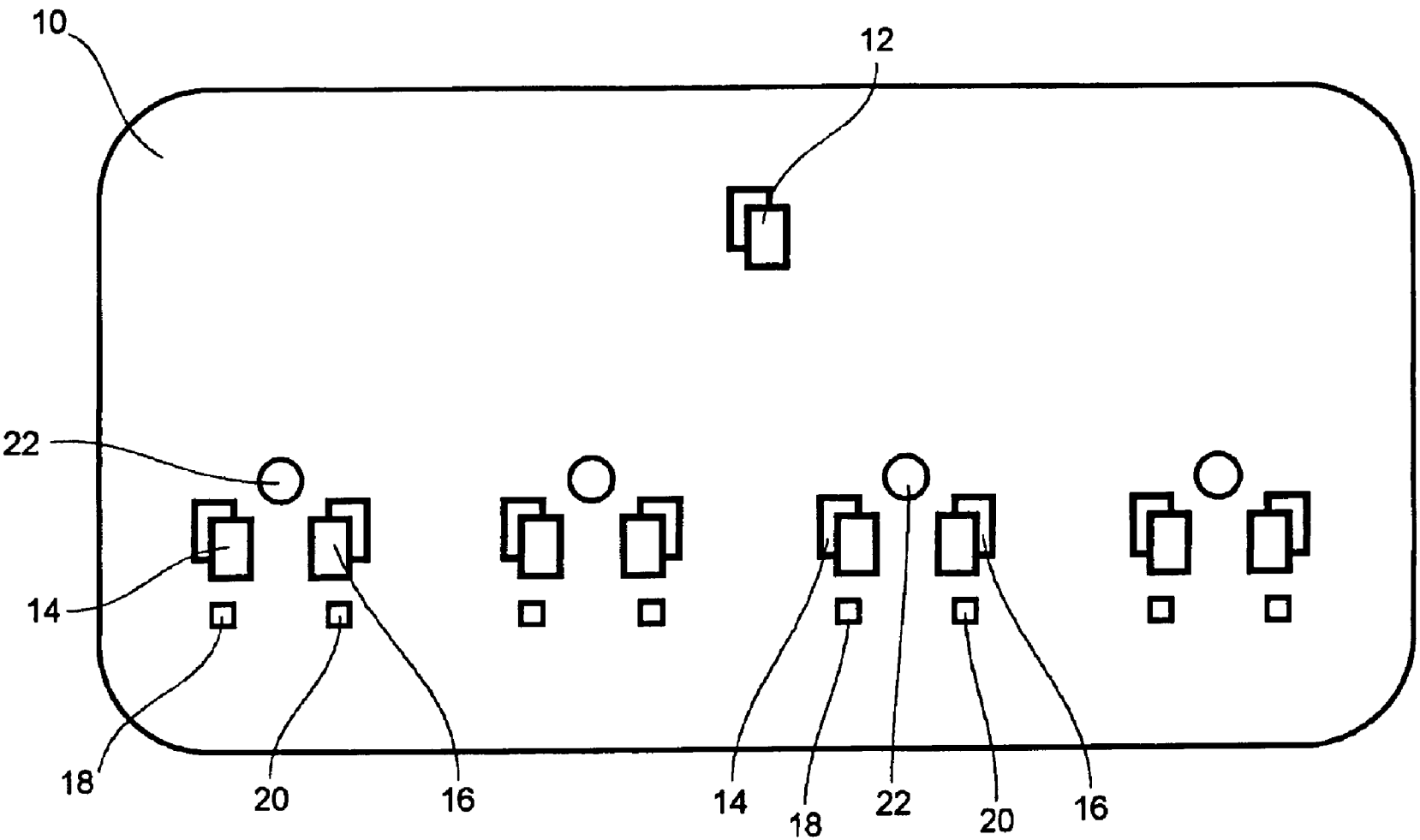

2002/0171201 A1 * 11/2002 Au-Yeung ..... 273/303
2003/0030217 A1 * 2/2003 Webb ..... 273/274
2003/0042679 A1 * 3/2003 Snow ..... 273/292
2003/0090063 A1 * 5/2003 Jarvis et al. ..... 273/292
2003/0107176 A1 * 6/2003 Goldman et al. ..... 273/292
2003/0151201 A1 * 8/2003 Lee ..... 273/292
2003/0173740 A1 * 9/2003 Weldon ..... 273/292
2003/0218303 A1 * 11/2003 Walker et al. ..... 273/292
2004/0080110 A1 * 4/2004 Webb ..... 273/292

* cited by examiner

CARD GAME

The present invention relates to a card game and in particular a card game suitable for use in casinos, based on a multi-handed version of blackjack or a like game, in which the object of the game is to achieve a total of 21 or some other specified number, when the values of the cards are added together, the winner of the game being closest to but not more than the specified number.

In a multi-handed blackjack game, each player has two or more hands which may be manipulated in some manner and then compared against a single hand dealt by the dealer. Typically in such games, each player is dealt two or more pairs of cards face up, to which further cards may be added at the player's request.

The present invention provides a card game in which further optional bets may be placed by the player on the matching of the cards initially dealt to him to specified hands.

According to one aspect of the present invention, a card game comprises a set of playing cards and a gaming cloth, characterised in that the gaming cloth defines an area in which a dealer may deal two or more cards constituting a house hand, and a plurality of player areas;

each player area defining an area in which two or more hands comprised of two or more cards may be dealt to a player;

areas corresponding to each hand for placing a bet on the hands beating the house hand; and an area in which optional bets may be placed on the matching of the cards dealt to each player to specified hands.

In accordance with a preferred embodiment of the present invention, initially each player will be dealt two or more pairs of cards face up, the optional bet being decided on the matching of the rank of two or more of the cards initially dealt to the player.

According to a further embodiment, cards dealt to the house hand may also be used by the player to match the specified hands when deciding the optional bet.

The set of cards may furthermore comprise two or more decks so that there will be cards of equal rank and suit, higher odds being paid on the matching of rank and suit, than on the matching of rank only.

Other specified hands in respect of The optional bet may include three or more cards of equal rank; three or more cards of consecutive rank (a straight); three or more cards of the same suit (a flush); three or more cards of equal rank and suit; three or more cards of consecutive rank and the same suit; or combinations thereof, depending on the number of hands dealt to each player. Odds may be paid on the optional bet, depending on the difficulty of achieving the specified hand.

The invention is now disclosed by way of example only, with reference to FIG. 1 which illustrates a gaming cloth in accordance with the present invention.

As illustrated in the accompanying drawing, a gaming cloth 10 is marked with an area 12 in which two cards may be dealt, one face up and one face down, to constitute a house hand. The gaming cloth 10 also defines a plurality of player areas, each player area comprising two areas 14,16 in which a pair of cards may be dealt face up to constitute two player hands. Areas 18,20 are provided for placing individual bets on each player hand and an area 22 is provided for placing an optional bet on the matching of the cards dealt in the areas 14 and 16 to specified hands.

In accordance with one embodiment of the game, a set of cards comprising six conventional decks of 52 cards are shuffled together.

Each player wishing to take part in the game then places a bet in areas 18 and 20 and also optionally in area 22. Two pairs of cards are then dealt face up to each player participating in the game in areas 14 and 16 and two cards one face up and one face down are dealt to the house in area 12.

The optional bet placed in area 22 is then decided on the basis of the four cards dealt to each player, odds being paid out to the matching of these cards in accordance with table 1 below.

TABLE 1

| Match | Odds |
|---|---|
| Two or more cards of matching rank and different suit | 1:1 |
| Two or more cards of matching rank and suit | 3:1 |
| Two or more aces of matching suit | 5:1 |

For example if a player is dealt K♠ and 3♦ in area 14, and 9♣ and 3♣ in area 16, then the optional bet will be paid out at 1:1. If however the player is dealt A♣ and 5♥ in area 14, and A♣ and 8♠ in area 16 the optional bet will be paid out at 5:1.

The above odds will provide an advantage to the house of 2.24%.

Alternatively, the odds given in Table 2 below will provide an advantage to the house of approximately 2%.

TABLE 2

| Match | Odds |
|---|---|
| Two cards of matching rank but different suit | 1:1 |
| Two cards of matching rank and suit | 6:4 |
| Three cards of matching rank but different suit | 5:1 |
| Three cards of matching rank and suit | 40:1 |
| Four cards of matching rank but different suit | 80:1 |
| Four cards of matching rank and suit | 1000:1 |

With these alternative odds a special bonus may be paid for, for example, four aces of a particular suit.

According to an alternative embodiment of the card game, the four cards dealt to each player plus the upturned card dealt to the dealer may be used to form a poker hand, different odds being paid out on the optional bet on the basis of the normal ranking of poker hands as illustrated in Table 3 below.

TABLE 3

| Hand | Match |
|---|---|
| Two Pair | Two cards of same rank |
| three of a kind | Three cards of the same rank |
| straight | five cards of consecutive rank |
| Flush | five cards of same suit |
| Full house | three cards of one rank and two cards of another rank |
| Four of a kind | four cards of same rank |
| Straight flush | five cards of consecutive rank and same suit |
| Royal flush | A K Q J 10 of same suit |

Again, the odds paid our on the matching of these hands would be fixed to reflect the difficulty in obtaining the specified hand.

According to a further embodiment, if a player is for example dealt four cards of equal rank and suit, and the house's face up card or some other card dealt, for example, after completion of the game, if matching the rank and suit of those dealt to the player may be used to provide a jackpot payout.

After settling the optional bets, each player may then stick with the cards dealt to him in areas 14 and 16 or may add to these cards in order to achieve a total of 21 or below when the values of the cards are added together. The face down house card is then revealed and optionally additional cards dealt to the house hand. Bets placed in areas 18 and 20 are then decided by comparing each player hand with the house hand, the one nearer to 21 winning, in accordance with the standard blackjack rules.

According to a further embodiment, when playing out the hands dealt in areas 14 and 16, the player may switch one card from each of the areas 14 and 16 to the other area 16,14 with a view to improving one or both hands.

Various modifications may be made without departing from the invention. For example, the odds quoted above may be varied as required. Furthermore, while in the embodiments disclosed above, each player is dealt with two hands, the game is suitable for any multi-handed card game, in which initially each player is dealt with two or more pairs of cards.

The above described game may also be adapted for internet entertainment and video slot machines. It could furthermore be stored on a disc and played on a computer or interactive television. In this respect the term 'gaming cloth' used herein is intended to cover a virtual representation of the gaming cloth. Moreover, use of the term 'cloth' is not intended to restrict the claims to use of particular material, but will cover any media which defines a playing area for the card game.

What is claimed is:

1. A card game in which each player places an initial bet on each of two or more hands to be played in accordance with rules of Blackjack, and also a further optional bet;

a dealer then deals, from a set of cards, two or more hands of two cards to each player and a single hand of two cards to the dealer;

the optional bet is then settled on a basis of all of the cards dealt to each player matching a specified hand, with the optional bet being paid out on a basis of a payout table;

each player then having an option to switch cards between the two or more hands; and the two or more hands dealt to each player are then played out in a conventional Blackjack manner, in order to settle the initial bets placed on each of the hands.

2. The card game according to claim 1, wherein each player is initially dealt two or more pairs of cards face up, and the optional bet being decided on the initial cards dealt to the player.

3. The card game according to claim 1, wherein each player is initially dealt two or more pairs of cards face up, and the optional bet being decided on the initial cards dealt to the player plus one card dealt to a house.

4. The card game according to claim 1, wherein the set of cards comprises at least two conventional decks of 52 playing cards.

5. The card game according to claim 1, wherein the optional bet is won by matching two or more cards of equal rank.

6. A card game according to claim 4, wherein the optional bet is won by matching two or more cards of equal rank and suit.

7. The card game according to claim 1, wherein the optional bet is won by matching three or more cards of consecutive rank.

8. The card game according to claim 1, wherein the set of cards comprises at least three decks of cards, and the optional bet is won by matching three or more cards of consecutive rank and a same suit.

9. The card game according to claim 1, wherein the set of cards comprises at least three decks of cards, and the optional bet is won by matching three or more cards of a same suit.

10. The card game according to claim 1, wherein odds paid out on the optional bet depends on odds of matching the specified hand.

11. A card game in which each player places an initial bet on each of at least two hands to be played in accordance with applicable rules of Blackjack, and each player having an option of placing an optional bet on the at least two hands to be played;

a dealer then deals at least two hands of two cards, from a set of cards comprising at least three doe of conventional playing cards, to each player and a single hand of two cards to the dealer;

the optional bet is then settled on a basis of all of the cards dealt to each player matching a specified hand, with the optional bet being paid out on a basis of a payout table;

each player then having an option to switch cards between the two or more hands; and the at least two hands dealt to each player are then played out according to applicable rules of Blackjack in order to settle the initial bets of each played placed on each of the hands according to the applicable rules of Blackjack.

* * * * *